US006082627A

United States Patent [19]

Raterman

[11] Patent Number: 6,082,627

[45] Date of Patent: Jul. 4, 2000

[54] DISPENSING NOZZLE, GUN AND FILTER AND METHOD USING VISUAL IDENTIFIERS FOR ORIFICE SIZE AND ENGAGEMENT DIMENSION

[75] Inventor: John M. Raterman, Atlanta, Ga.

[73] Assignee: Nordson Corporation, Westlake, Ohio

[21] Appl. No.: 09/165,876

[22] Filed: Oct. 2, 1998

[51] Int. Cl.[7] ..... B05B 17/00

[52] U.S. Cl. ..... 239/1; 239/71

[58] Field of Search ..... 239/71, 73, 74, 239/589, 590, 590.3, 596; 222/189.06

[56] References Cited

U.S. PATENT DOCUMENTS

| | | | |
|---|---|---|---|
| 3,543,332 | 12/1970 | Wagner et al. | 18/8 |
| 4,066,188 | 1/1978 | Scholl et al. | 222/146 |
| 4,346,848 | 8/1982 | Malcolm | 239/596 |
| 4,570,858 | 2/1986 | Bintner et al. | 239/71 X |
| 5,265,803 | 11/1993 | Thayer | 239/71 |
| 5,277,344 | 1/1994 | Jenkins | 222/504 |
| 5,356,079 | 10/1994 | Rahbar | 239/590 X |
| 5,544,813 | 8/1996 | Giles et al. | 239/71 |
| 5,709,923 | 1/1998 | Ciaramitaro | 428/195 |

OTHER PUBLICATIONS

Nordson Corporation, *Nordson Replacement Parts Work Better, Last Longer, and are Priced Right. Why Buy Anything Else?,* 1997.

Nordson Corporation, *Controlled Fiberization™ Technology,* Brochure, Reissued Jun. 1996.

Nordson Corporation, *Series H–200 Hot Melt Guns,* Brochure, Reissued Jun. 1998.

ITW, *ITW Dynatec EZ Nozzles,* May 21, 1998.

Slautterback, *Automatic Extrusion Nozzles,* Jul. 1997.

Nordson Corporation, *1995 Adhesivees and Sealants Equipment Catalog,* p. 10–4.

*Primary Examiner*—Andres Kashnikow
*Assistant Examiner*—Sean P. O'Hanlon
*Attorney, Agent, or Firm*—Wood, Herron & Evans, L.L.P.

[57] ABSTRACT

Dispensing apparatus and methods related to a nozzle, gun and filter for dispensing viscous liquid materials. The nozzle includes a nozzle body having a dispensing orifice with a diameter and an engagement dimension. A first visually identifiable indicium is provided on the body portion to indicate the orifice diameter and a second visually identifiable indicium is provided on the body portion independently from the first indicium to indicate the engagement dimension of the nozzle. To provide for easy and precise indication of the nozzle, at least one of the first and second indicia is a colored marking. A dispensing gun and filter used, for example, in a hot melt adhesive dispensing system also incorporate generally similar indications of nozzle orifice and engagement dimensions.

46 Claims, 3 Drawing Sheets

DISPENSING NOZZLE, GUN AND FILTER AND METHOD USING VISUAL IDENTIFIERS FOR ORIFICE SIZE AND ENGAGEMENT DIMENSION

FIELD OF THE INVENTION

The present invention generally relates to fluid dispensing systems for dispensing liquid materials, such as hot melt adhesive, and, more specifically, manners of visually indicating different orifice sizes and engagement dimensions associated with the nozzles of such systems.

BACKGROUND OF THE INVENTION

Typically, components of a dispensing system, such as the dispensing guns, filters and nozzles, have part numbers related to the specific component size, flow rating, or other component characteristics. These part numbers may be stamped or otherwise indicated on the component. It has been known to color code nozzles for purposes of identifying orifice size and/or flow rate associated with the nozzle. For example, the assignee of the present invention has sold nozzles for purposes of applying adhesive to nonwoven materials in which the retaining nuts associated with the nozzles are of a specific single color designating a specific size of the dispensing orifice.

Especially when dispensing relatively viscous liquids, such as hot melt adhesive, orifice size designation is not sufficient to define the ultimate flow rate from the nozzle. In this regard, a so-called engagement dimension or length, which essentially refers to the dispensing orifice length, also significantly affects the flow rating of the nozzle. With regard to orifice diameter, the flow rate will generally increase exponentially with increasing orifice diameter and will decrease linearly with respect to an increasing engagement dimension. Various types of nozzles are available, including extrusion nozzles which simply extrude one or more beads of adhesive and so-called swirl nozzles which extrude a bead of adhesive which is then impacted by air emitted from the nozzle to create a swirled adhesive pattern. In each case, both the orifice diameter and the engagement dimension are necessary factors to consider when determining the appropriate nozzle for a given application under specific material, pressure and temperature conditions.

A significant problem in the industry with respect to the nozzles noted above relates to replacement of the nozzles with like nozzles during maintenance or repair. If the orifice diameter and the engagement dimension are unknown to the maintenance or repair personnel, then accurate records must be kept to ensure that nozzles having the same orifice diameter and engagement dimension are replaced on the dispensing apparatus. Both of these dimensions must be held constant after any maintenance to maintain the same flow rate. If the apparatus is repaired or maintained using nozzles having either incorrect orifice diameter or incorrect engagement length, this could significantly and adversely affect the application of the viscous liquid material. Oftentimes, nozzles may be covered with adhesive and a part number of the nozzle may not be easily identified by inspecting the nozzle during use. Therefore, the apparatus must be shut down and the nozzle must be removed and inspected before it is possible to determine the correct nozzle size. The necessity for this close inspection can require significantly increased down time for the dispenser. Particular problems also exist with filters used in such dispensing systems. For example, if a filter size is not properly matched with the orifice size of a nozzle, then the orifice of the nozzle itself may act as the filter and become clogged with particulate matter.

For reasons such as those outlined above, it would desirable to provide nozzles and other dispensing hardware having improved visual identification capabilities.

SUMMARY OF THE INVENTION

The present invention provides a nozzle for dispensing viscous liquid materials comprising a nozzle body having a dispensing orifice with a diameter and an engagement dimension. The nozzle body includes first and second visually identifiable indicia respectively indicative of the orifice diameter and the engagement dimension associated with the nozzle. The nozzle body may be an integral nozzle body which may have a hex surface or other tool engagement surface for attaching the nozzle to a suitable dispensing apparatus or may be a multiple piece nozzle body, for example, having a retaining nut and a disc which includes a dispensing orifice and, optionally, a plurality of air orifices.

Although many different visually identifiable indicia may be used to separately indicate the orifice diameter and engagement dimension associated with the nozzle, at least one of the indicia is preferably a colored marking. More preferably, different colors may be chosen for respectively indicating orifice diameter and engagement dimension. These markings may be rings encircling the nozzle body. The rings, for example, may be painted rings on the nozzle body or colored grooves in the nozzle body or separate colored rings removably or non-removably affixed within grooves in the nozzle body. One alternative to rings is separately colored dots or other discrete markings disposed on the nozzle body. Another alternative would be colored numbers or other color-coded indicia. As yet another alternative, specifically designed for two-piece nozzles, a retaining nut portion of the nozzle body may be formed with one color to indicate, for example, orifice size, while a disc which contains the dispensing orifice may be separately colored to designate the engagement dimension.

The invention further contemplates a method of independently indicating a specific orifice diameter and engagement dimension on a nozzle used for dispensing viscous liquid materials. The method comprises providing a first visually identifiable indicium on an outside surface of the nozzle to indicate the orifice diameter of the nozzle and providing a second visually identifiable indicium on the outside surface of the nozzle to indicate the engagement dimension of the nozzle. This method may be more specifically defined to cover the nozzle variations mentioned above with respect to the nozzle of this invention.

Also in accordance with the invention, a dispensing gun may be provided with indicia that correspond to the orifice diameter and engagement dimension of the nozzle. This may provide a more visible indication of the orifice size and engagement dimension associated with the gun, such as for those applications in which the nozzles are not readily visible. The visually identifiable indicia on the dispensing gun body may again comprise colored rings in grooves or, alternatively, removable rings, such as colored O-rings. The use of removable O-rings will facilitate the ability to change from one nozzle size to another while also changing the corresponding indicia on the gun body.

Finally, the invention contemplates the use of similar visually identifiable indicia on a replaceable filter which may be used in a system for dispensing liquid material with the nozzles and guns described above. The filter may, for example, include a portion having visually identifiable indicia corresponding in a predetermined manner to the indicia described above in connection with the nozzles and gun of the present invention. Again, the visually identifiable indicia associated with the filter may comprise colored rings, including painted continuous or discontinuous rings, colored numbers or other colored-coded characters such as alphabetic or alphanumeric characters, colored grooves, or colored O-rings disposed about a tool engaging portion of the filter. The visually identifiable indicia may correspond directly with the visually identifiable indicia of the nozzles and guns of this invention, or may correspond to the size of the filter required for a range of nozzles and/or guns used in the dispensing system.

Additional objectives, advantages and variations of the invention will become more apparent to those of skill in the art upon review of the following detailed description of the invention taken in conjunction with the accompanying drawings.

DETAILED DESCRIPTION OF THE PREFERRED EMBODIMENTS

Figure 1:
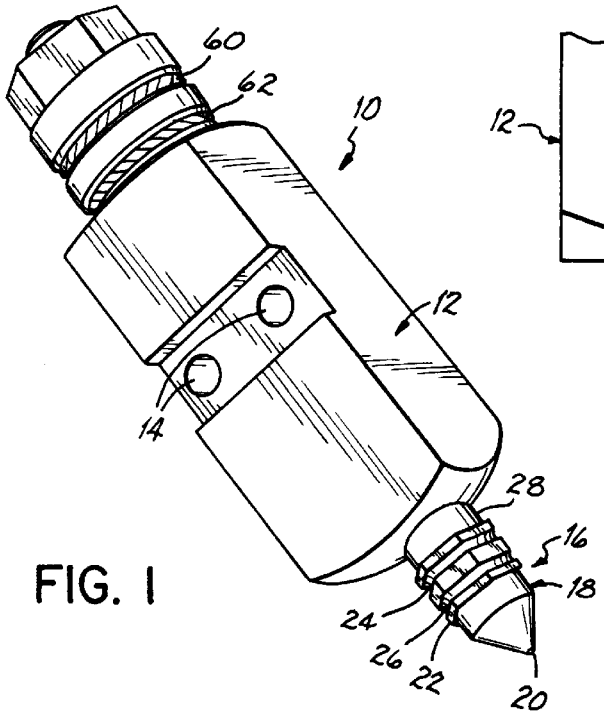
FIG. 1 is a perspective view of a dispensing gun, typically used for dispensing hot melt adhesives, and constructed in accordance with one preferred embodiment of the invention.

Referring first to FIG. 1, a dispensing gun 10 is shown and configured for dispensing relatively viscous liquid materials, such as hot melt adhesive. Gun 10 typically includes a dispenser body 12 which may be mounted to suitable support structure using fasteners (not shown) disposed through mounting holes 14. Dispensers such as dispenser 10 are typically constructed with internal valves and passageways for receiving a supply of viscous liquid material, such as hot melt adhesive, under pressure. When the valve is open, adhesive is dispensed from a nozzle 16. Representative dispensing guns are shown in U.S. Pat. Nos. 5,934,520, 4,066,188 and 5,277,344, each being assigned to the assignee of the present invention. It will be appreciated that the invention may be easily applied to a wide variety of dispensing apparatus, including various types of guns or dispensing manifolds, or other apparatus.

Nozzle 16 is constructed in accordance with one preferred embodiment of the invention and includes a nozzle body 18 having a dispensing orifice 20. It will be appreciated that nozzle 16 may be constructed to include a plurality of orifices for dispensing multiple beads of material. In one typical construction, nozzle body 18 is a single-piece, integral structure including a hex-shaped outer surface portion 22. Nozzle body 18 is internally threaded and an extension 28 of dispenser body 12 is externally threaded. Therefore, hex-shaped surface 22 may be engaged by a wrench and attached to tighten nozzle 16 onto extension 28 of dispenser body 12.

Figure 2:
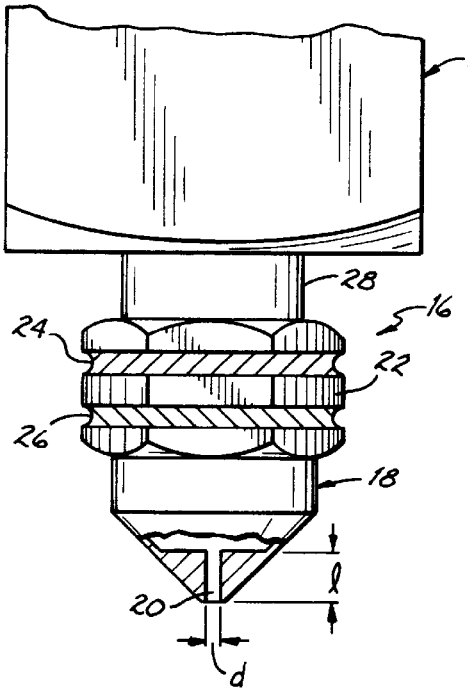
FIG. 2 is a side elevational view of the nozzle shown in FIG. 1.

Referring more specifically to FIG. 2, hex-shaped outer surface 22 includes first and second grooves 24, 26 which are colored, such as with paint, to provide separate indications, respectively, of the engagement dimension or length "I" associated with dispensing orifice 20 and the diameter "d" of dispensing orifice 20. For example, groove 24 may be colored brown, as indicated by the cross-hatching, to denote a 0.100 inch engagement length. Groove 26 may be colored green, as indicated by the cross-hatching, to denote a 0.16 inch diameter orifice 20. The following table represents the currently preferred color scheme respectively associated with orifice diameter and engagement length:

| Orifice Diameter (Inches) | Color | Engagement Length (Inches) | Color |
|---|---|---|---|
| .08 | Black | .050 | White |
| .10 | Violet | .075 | Silver |
| .12 | Dark Blue | .100 | Brown |
| .14 | Light Blue | .150 | Bronze |
| .16 | Green | .300 | Black |
| .18 | Yellow | | |
| .20 | Orange | | |
| .21 | Red | | |
| .24 | White | | |
| .28 | Bronze | | |
| .40 | Silver | | |

Preferably, the colors chosen do not directly match the light spectrum color scheme for various reasons. For example, it is desirable that a major contrast between colors exists as between orifice diameters that are very similar. This is because it would be relatively easy to confuse a 0.10 diameter orifice with a 0.12 diameter orifice if colors without major contrast are chosen to represent these two similar sizes. Also, the spectrum colors do not permit an easy or wide selection of colors. Colors are preferably not reused as between the indicators for orifice diameter and engagement length or dimension. This eliminates any confusion and any need on the part of the user to determine which color represents the orifice diameter and which color represents the engagement dimension. In the example given in FIG. 2, for example, the user would not need to know that the green color of groove 24 represents a 0.16 inch orifice diameter and the brown color of groove 24 represents a 0.100 inch engagement length. In this way, the user would not even have to know that the upper color represents engagement length and the lower color represents orifice diameter, but may simply refer to a nozzle 16 which has green and brown rings and this will precisely identify the correctly sized nozzle.

Figure 4:
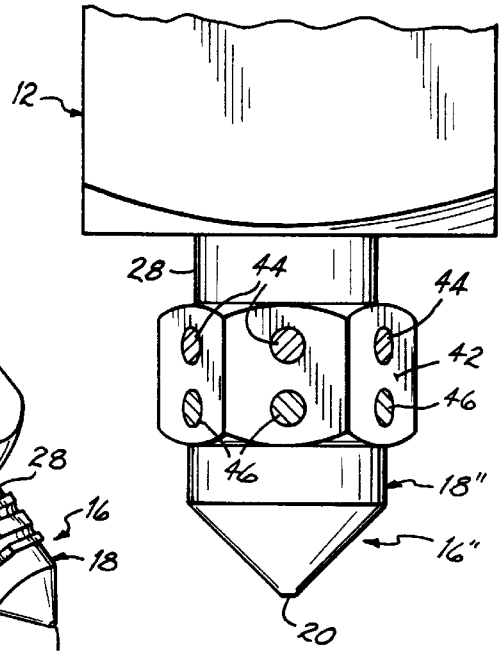
FIG. 4 is a side elevational view of another alternative embodiment of a nozzle constructed in accordance with the invention.
Figure 3:
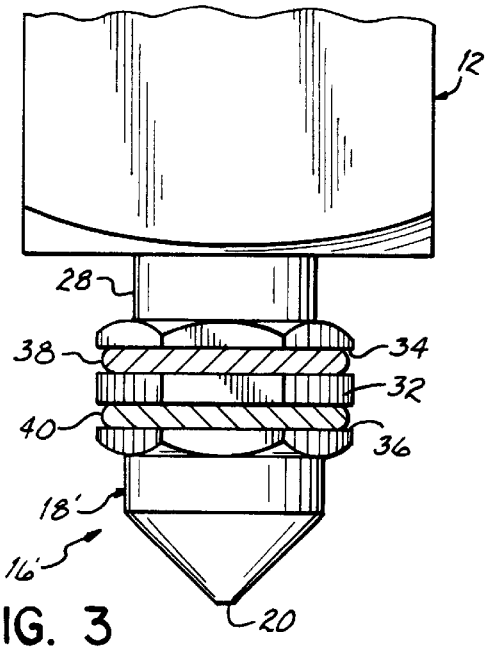
FIG. 3 is a side elevational view of a first alternative embodiment of a nozzle constructed in accordance with the invention.
Figure 5:
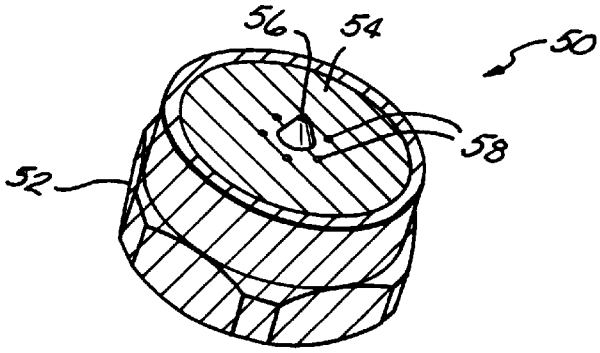
FIG. 5 is a perspective view of another alternative embodiment of a multi-piece nozzle constructed in accordance with the invention.

FIGS. 3–5 represent variations of the embodiment shown in FIGS. 1 and 2. Like reference numerals refer to like elements in all drawings whereas reference numerals with one or more prime marks (') refer to slightly modified structure. Specifically, FIG. 3 illustrates a nozzle 16' including a one-piece nozzle body 18' connected to dispenser body 12 and including a dispensing orifice 20. In this embodiment, nozzle body 18' again includes a hex-shaped outer surface 32 for engagement with a wrench, and a pair of upper and lower grooves 34, 36. In accordance with this embodiment, however, grooves 34, 36 contain respective rings 38, 40, such as rubber R-rings or metal retainer rings, affixed therein. As again indicated by crosshatching, rings 38, 40 are colored brown and green to provide the same illustrative engagement length and orifice diameter designations as discussed with respect to FIG. 2. Of course, the other orifice diameters and engagement lengths will be designated by the other appropriate colors. In this embodiment, rings 38, 40 are affixed such that they do not interfere with the engagement of a wrench. This may be accomplished, for example, by sufficiently recessing rings 38, 40 into surface 32.

FIG. 4 illustrates a nozzle 16" having a nozzle body 18", and again in the form of a single-piece structure having a hex-shaped outer surface portion 42 and a dispensing orifice 20. Hex-shaped surface portion 42 includes upper and lower series of dots 44, 46. Dots 44 are colored brown and lower dots 46 are colored green, as indicated by the cross-hatching, to provide the same engagement length and orifice diameter designations as discussed with respect to FIG. 2.

Figure 4A:
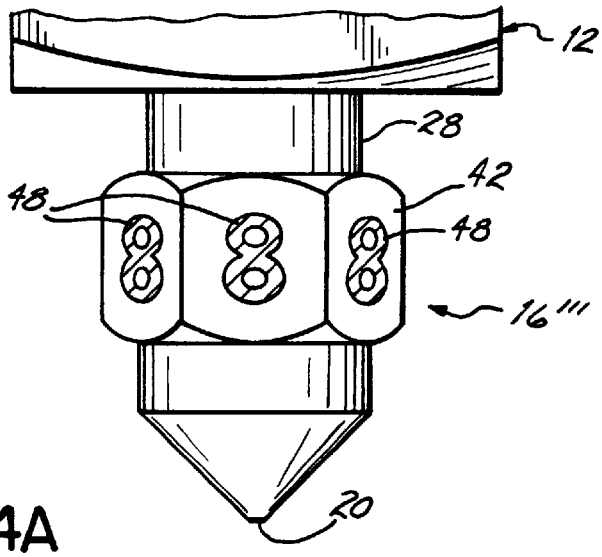
FIG. 4A is a side elevational view of another alternative embodiment of a nozzle constructed in accordance with the invention.

FIG. 4A illustrates another alternative nozzle 16"' in which colored indicia 48 is imprinted onto the hex-shaped surface portion 42. Preferably, indicia 48 again appears on each face of the hex-shaped surface 42 and, in this example, comprises a colored numeral "8". Specifically, in this embodiment the numeral "8" itself may indicate a particular orifice size, while the color of the numeral "8" may indicate the engagement length. Like the other embodiments, this simplifies the identification process for maintenance and repair personnel since they do not need to identify and recall a particular part number, but instead can simply identify and recall the color-coded indicia representative of both the orifice diameter and the engagement length. It will further be appreciated that this embodiment integrates and embodies the first and second indicium of the nozzle 16"' into a single imprint on nozzle 16"'. This can make manufacturing of the nozzle easier than other manners of practicing the present invention.

FIG. 5 illustrates a two-piece nozzle body 50 which comprises a retainer nut 52, engageable by a wrench as with the previously discussed hex-shaped portions, and a dispensing disc 54 which is retained in place by nut 52. Dispensing disc 54 may include, for example, a central dispensing orifice 56 and a surrounding array of air orifices 58 for creating a swirled pattern of the dispensed liquid. In accordance with the invention, the retainer nut may be produced in a series of colors to indicate orifice diameter as outlined in the table above, while the dispensing disc may be provided in a second series of colors indicating engagement dimension or length, as also outlined in the table above. The result is the same in that the user may simply indicate the need for nozzles having brown retainer nuts and green dispensing discs, for example, and this will provide all the information necessary to precisely designate the nozzle in use and in need of replacement.

Again referring to FIG. 1, dispensing gun 10 may be provided with indicia that correspond to the orifice diameter and engagement dimension of the nozzle 16. This may provide a more visible indication of the orifice size "d" and engagement dimension "l" (FIG. 2) associated with the gun 10 for those applications in which the nozzles 16 are not readily visible. The visually identifiable indicia on dispensing gun body 12, for example, may comprise one or more colored rings in grooves or, alternatively, one or more removable rings, such as colored O-rings 60, 62 which are the same colors as the corresponding indicia on nozzles 16. The use of removable O-rings 60, 62 will facilitate the ability to change from one nozzle size to another while also changing the corresponding indicia on the gun body.

Figure 6:
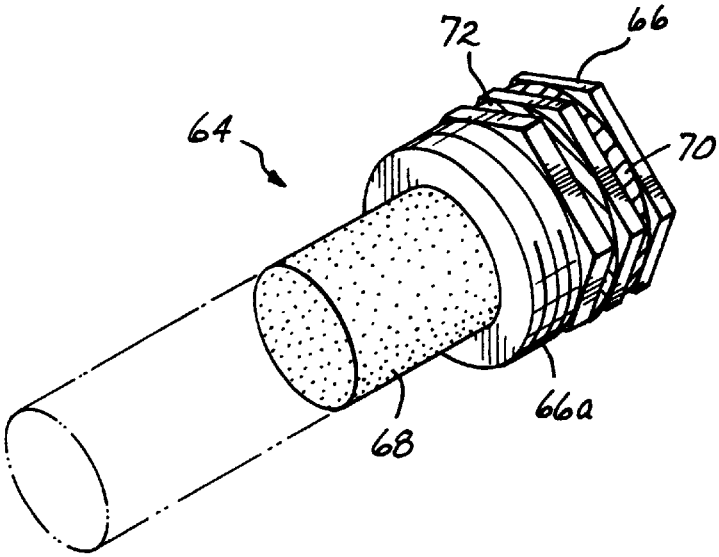
FIG. 6 is a perspective view of a filter constructed according to another aspect of the invention.

With reference to FIG. 6, the invention contemplates the use of similar visually identifiable indicia on a replaceable filter 64 which may be used in a system for dispensing liquid material with dispensing guns such as gun 10 having nozzle 16 as described above. Filter 64 may, for example, include a tool engaging, exposed portion 66 and a perforate filtering portion 68. Although filter 64 may take many forms and sizes, an illustrative form is shown having threads 66*a* for connecting filter 64 in, for example, a heated manifold. Portion 66 may include visually identifiable indicia generally or directly corresponding to the indicia described above in connection with the nozzles 16, 16', 16" and gun 10 of the present invention. Again, the visually identifiable indicia associated with filter 64 may comprise one or more colored rings, including colored grooves, or one or more colored O-rings 70, 72 as shown disposed about tool engaging portion 66. Other alternatives would be colored dots, colored dashed lines or other discrete markings which may form a discontinuous ring, colored numbers, or any other color-coded indicia. The visually identifiable indicia may correspond directly with one or both of the visually identifiable indicia of the gun and/or nozzles of this invention or, for example, may correspond to the size of the filter required for the particular nozzles and/or guns used in a specific dispensing system. Such an indicium on filter 64 can at least prevent inadvertent use of the wrong filter size for a particular nozzle orifice diameter.

Figure 7:
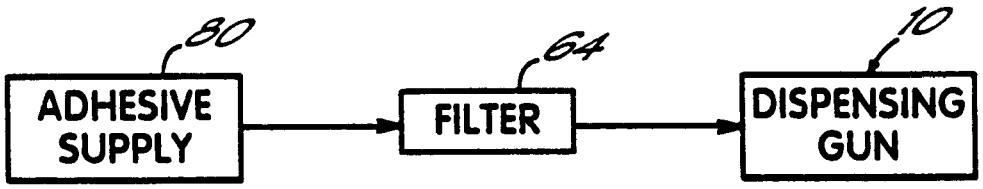
FIG. 7 is a block diagram showing a dispensing system incorporating a dispensing gun and filter which may each incorporate the present invention.

FIG. 7 diagrammatically illustrates the connection of filter 64 upstream of dispensing gun 10 for filtering liquid material, such as hot melt adhesive, prior to the liquid being directed into gun 10. Filter 64 may receive hot melt adhesive in any suitable manner from an adhesive supply 80, such as a melting unit.

While the present invention has been illustrated by a description of various embodiments and while these embodiments have been described in some detail, it is not the intention of the Applicants to restrict or in any way limit the scope of the appended claims to such detail. Additional advantages and modifications will readily appear to those skilled in the art. One main aspect of the invention relates to the separate and distinct color-coded markings which may be used to separately indicate the orifice diameter and engagement length of a nozzle. Representative indicia or markings have been shown and described, however, other visually identifiable markings may be used as well. For example, additional representative indicia are shown in U.S. Ser. Nos. 29/092,588 and 29/092,589, each assigned to the assignee of the present invention. The disclosures of these two design applications are hereby incorporated by reference herein. The invention in its broader aspects is therefore not limited to the specific details, representative apparatus and method as shown and described. This has been a description of the present invention, along with the preferred methods of practicing the present invention as currently known. However, the invention itself should only be defined by the appended claims, wherein I claim.

What is claimed is:

1. A nozzle for dispensing liquid materials, the nozzle comprising:

a nozzle body having a dispensing orifice with a diameter and an engagement dimension, a first visually identifiable indicium on the nozzle body indicative of the orifice diameter, a second visually identifiable indicium on the nozzle body independent from the first visually identifiable indicium and indicative of the engagement dimension, and wherein at least one of the first and second visually identifiable indicia is a color-coded indicium.

2. The nozzle of claim 1, wherein the first and second visually identifiable indicia comprise a colored character.

3. The nozzle of claim 1, wherein different colored markings are respectively used for the first and second visually identifiable indicia.

4. The nozzle of claim 3, wherein the colored markings are rings encircling the nozzle body.

5. The nozzle of claim 4, wherein the rings are separate members secured within grooves in the nozzle body of the nozzle.

6. The nozzle of claim 4, wherein the rings are colored grooves in the nozzle body.

7. The nozzle of claim 3, wherein the colored markings are discrete markings encircling at least a portion of the nozzle body.

8. The nozzle of claim 1, wherein the nozzle body includes at least first and second attachable pieces, and the first piece includes the first visually identifiable indicium and the second piece includes the second visually identifiable indicium.

9. The nozzle of claim 8, wherein the first piece is a retainer nut and the second piece is a dispensing disc including said dispensing orifice.

10. A method of independently indicating a specific orifice diameter and engagement dimension of a nozzle used for dispensing liquid materials, the method comprising:

indicating the orifice diameter of the nozzle using a first visually identifiable indicium on an outside surface of the nozzle, indicating the engagement dimension of the nozzle using a second visually identifiable indicium on the outside surface of the nozzle, and wherein at least one of the first and second visually identifiable indicia is a color-coded indicium.

11. The method of claim 10, wherein the first and second visually identifiable indicia comprise a colored character.

12. The method of claim 10, wherein different colored markings are respectively used for the first and second visually identifiable indicia.

13. The method of claim 12, wherein the colored markings are rings encircling the nozzle body.

14. The method of claim 13, wherein the rings are separate members secured within grooves in the nozzle body of the nozzle.

15. The method of claim 13, wherein the rings are colored grooves in the nozzle body of the nozzle.

16. The method of claim 12, wherein the colored markings are discrete markings encircling at least a portion of the nozzle body.

17. The method of claim 10, wherein the nozzle body includes at least first and second attachable pieces, and the first piece includes the first visually identifiable indicium and the second piece includes the second visually identifiable indicium.

18. The method of claim 17, wherein the first piece is a retainer nut and the second piece is a dispensing disc including said dispensing orifice.

19. Dispensing apparatus for dispensing liquid materials, the dispensing apparatus comprising:

a dispensing gun, a nozzle connected with the dispensing gun and having a dispensing orifice with a diameter and an engagement dimension, a first visually identifiable indicium on the nozzle indicative of the orifice diameter, a second visually identifiable indicium on the nozzle independent from the first visually identifiable indicium and indicative of the engagement dimension, a third visually identifiable indicium on the dispensing gun indicative of the orifice diameter and correlated to the first visually identifiable indicium, a fourth visually identifiable indicium on the dispensing gun independent from the third visually identifiable indicium and indicative of the engagement dimension and correlated to the second visually identifiable indicium, and wherein at least one of the first and second visually identifiable indicia is a color-coded indicium and at least one of the third and fourth visually identifiable indicia is a color-coded indicium.

20. The dispensing apparatus of claim 19, wherein the first, second, third and fourth visually identifiable indicia are colored markings.

21. The dispensing apparatus of claim 20, wherein the first and second visually identifiable indicia respectively comprise first and second different colors and the third and fourth visually identifiable indicia respectively comprise said first and second different colors.

22. The dispensing apparatus of claim 20, wherein the first, second, third and fourth visually identifiable indicia are rings respectively encircling the nozzle and the dispensing gun.

23. The dispensing apparatus of claim 22, wherein the rings are separate members secured within grooves respectively in the nozzle and the dispensing gun.

24. The dispensing apparatus of claim 22, wherein the rings are colored grooves respectively in the nozzle and the dispensing gun.

25. The dispensing apparatus of claim 20, wherein the colored markings are discrete markings encircling at least a portion of the nozzle and the dispensing gun.

26. The dispensing apparatus of claim 19, wherein the nozzle includes at least first and second attachable pieces, and the first piece includes the first visually identifiable indicium and the second piece includes the second visually identifiable indicium.

27. The dispensing apparatus of claim 26, wherein the first piece is a retainer nut and the second piece is a dispensing disc including said dispensing orifice.

28. The dispensing apparatus of claim 27 further comprising a filter connected upstream of the dispensing gun, wherein the filter includes:

a perforate portion disposed in a liquid flow path for allowing the liquid to flow therethrough while filtering particles from the liquid, and an exposed portion adapted to be viewed while the filter is connected in the dispensing system, said exposed portion including a fifth visually identifiable indicium corresponding to the orifice diameter and to the first visually identifiable indicium.

29. The dispensing apparatus of claim 28 further comprising a sixth visually identifiable indicium on the exposed portion, the sixth visually identifiable indicium corresponds to the engagement dimension and to the second visually identifiable indicium.

30. A filter for use in a dispensing system in which liquid is dispensed from at least one nozzle having a dispensing orifice with a diameter and an engagement dimension, the filter comprising:

a perforate portion adapted to be disposed in a liquid flow path for allowing the liquid to flow therethrough while filtering particles from the liquid, and an exposed portion adapted to be viewed while the filter is connected in the dispensing system, said exposed portion including a first visually identifiable indicium corresponding to the orifice diameter.

31. The filter of claim 30 further comprising a second visually identifiable indicium on the exposed portion, wherein the second visually identifiable indicium corresponds to the engagement dimension.

32. The filter of claim 31, wherein the first and second visually identifiable indicia are colored markings.

33. The filter of claim 32, wherein different colored markings are respectively used for the first and second visually identifiable indicia.

34. The filter of claim 33, wherein the colored markings are rings encircling the exposed portion.

35. The filter of claim 34, wherein the rings are separate members secured within grooves in the exposed portion.

36. A method of independently indicating a specific orifice diameter and engagement dimension of a nozzle connected with a dispensing gun in a dispensing system for dispensing liquid materials, the method comprising:

indicating the orifice diameter of the nozzle using a first visually identifiable indicium on an outside surface of the nozzle, indicating the engagement dimension of the nozzle using a second visually identifiable indicium on the outside surface of the nozzle, indicating the orifice diameter of the nozzle using a third visually identifiable indicium on the dispensing gun which corresponds to the first visually identifiable indicium, and indicating the engagement dimension of the nozzle using a fourth visually identifiable indicium on the dispensing gun which corresponds to the second visually identifiable indicium.

37. The method of claim 36, wherein the first, second, third and fourth visually identifiable indicia are colored markings.

38. The method of claim 37, wherein the first and second visually identifiable indicia respectively comprise first and second different colors and the third and fourth visually identifiable indicia respectively comprise said first and second different colors.

39. The method of claim 37, wherein the first, second, third and fourth visually identifiable indicia are rings respectively encircling the nozzle and the dispensing gun.

40. The method of claim 39, wherein the rings are separate members secured within grooves respectively in the nozzle and the dispensing gun.

41. The method of claim 39, wherein the rings are colored grooves respectively in the nozzle and the dispensing gun.

42. The method of claim 37, wherein the colored markings are discrete markings encircling at least a portion of the nozzle and the dispensing gun.

43. The method of claim 36, wherein the nozzle includes at least first and second attachable pieces, and the first piece includes the first visually identifiable indicium and the second piece includes the second visually identifiable indicium.

44. The method of claim 43, wherein the first piece is a retainer nut and the second piece is a dispensing disc including said dispensing orifice.

45. The method of claim 36 further comprising a filter connected upstream of the dispensing gun, wherein the filter includes a perforate portion disposed in a liquid flow path for allowing the liquid to flow therethrough while filtering particles from the liquid, and wherein the method further comprises:

indicating the orifice diameter using a fifth visually identifiable indicium on an exposed portion of the filter adapted to be viewed while the filter is connected in the dispensing system, said fifth visually identifiable indicium corresponding to the orifice diameter and to the first visually identifiable indicium.

46. The method of claim 45 further comprising:

indicating the engagement dimension using a sixth visually identifiable indicium on the exposed portion of the filter, wherein the sixth visually identifiable indicium corresponds to the engagement dimension and to the second visually identifiable indicium.

* * * * *